US005746623A

United States Patent [19]

Fuchs et al.

[11] Patent Number: 5,746,623

[45] Date of Patent: May 5, 1998

[54] AXIALLY ADJUSTABLE COAXIAL ELECTRICAL CONNECTING LINE WITH CONSTANT IMPEDANCE

[75] Inventors: Josef Fuchs, Appenzell; Mario Schneider, Oberriet, both of Switzerland

[73] Assignee: Huber & Suhner AG, Herisau, Switzerland

[21] Appl. No.: 656,047

[22] Filed: May 31, 1996

[30] Foreign Application Priority Data

Jun. 1, 1995 [CH] Switzerland ..... 1613-95

[51] Int. Cl.[6] ..... H01R 9/05

[52] U.S. Cl. ..... 439/578

[58] Field of Search ..... 439/578–585, 439/675, 843; 333/160

[56] References Cited

U.S. PATENT DOCUMENTS

| | | | |
|---|---|---|---|
| 3,678,447 | 7/1972 | Ziegler, Jr. et al. | 439/585 |
| 4,588,241 | 5/1986 | Ardezzone | 439/581 |
| 4,741,702 | 5/1988 | Yasumoto | 439/578 |
| 4,772,223 | 9/1988 | Yasumoto | 439/578 |
| 4,779,067 | 10/1988 | Johanson | 333/160 |
| 4,797,126 | 1/1989 | Botka | 439/843 |

FOREIGN PATENT DOCUMENTS

| | | |
|---|---|---|
| 2 183 111 | 5/1987 | United Kingdom . |
| WO89/03600 | 4/1989 | WIPO . |

*Primary Examiner*—Neil Abrams
*Assistant Examiner*—Brian J. Biggi
*Attorney, Agent, or Firm*—Sughrue, Mion, Zinn, Macpeak & Seas, PLLC

[57] ABSTRACT

A coaxial electrical connecting line is provided with an integrated adjusting device 4 for the mechanical fine adjustment of the electrical length of the line. The adjusting device has outside and inside conductors 6, 7. The outside conductor has two housing parts 14, 15 which can be phaselessly moved toward and away from each other between two terminal positions by turning a clamping sleeve 9. The inside conductor is provided with two telescoping connecting parts 16, 18 that can also be moved toward and away from each other; each is connected with an associated housing part. The inside diameters (D) of the two housing parts and the outside diameters (d) of the two connecting parts are so dimensioned that the adjusting device has a constant impedance over its entire length.

7 Claims, 1 Drawing Sheet

AXIALLY ADJUSTABLE COAXIAL ELECTRICAL CONNECTING LINE WITH CONSTANT IMPEDANCE

BACKGROUND OF THE INVENTION

This invention relates to a coaxial electrical connecting line with an integrated adjusting device for the mechanical fine adjustment of the electrical length of the connecting line, wherein the adjusting device has an outside conductor and an inside conductor.

Connecting lines of this kind have been known for a long time, especially for data transmission in the high-frequency range, particularly in the gigahertz range. The electrical length can change when these connecting lines are installed. With the help of the adjusting device, one can then adapt the electrical length without dismantling and with simultaneous measurement. The adjusting device is integrated into the connecting line and forms a coupling. The adjusting device, also called a trimmer, can be cast after adaptation of the electrical length.

GB-A-2,183,111 shows a coupling device for coaxial transmission lines that likewise facilitates the adaptation of the electrical length of a connecting line. In this coupling device, the outside conductor is essentially formed by a clamping sleeve that has two opposite inside threads arranged at an interval with respect to each other. As the clamping sleeve is turned, the interval between the two connecting parts is changed and, simultaneously, two telescopically mutually engaging connection parts are shifted with respect to each other. In this coupling arrangement, it is particularly disadvantageous that the electrical contact is not adequately defined via the two threads and that the structural return loss can change during adjustment. This device, therefore, is not suitable for higher frequencies, especially in the gigahertz range. Another disadvantage is that the impedance is not constant over the adjusting range.

SUMMARY OF THE INVENTION

The object of the invention is to provide a connecting line with an integrated adjusting device of the kind mentioned, that will not be made as a coupling device and that will also be suitable for higher frequencies, particularly in the gigahertz range, and which, nevertheless, can be made at reasonable cost and will be easily operable with a comparatively simple structure.

This problem is solved in that the outside conductor has two housing parts that, for example, by means of a clamping sleeve, can be moved phaselessly toward each other between two terminal positions, while the inside conductor has, in particular, connecting parts that can be moved telescopically toward each other, each of which parts is connected with a housing part. The inside diameters of the two housing parts and the outside diameters of the two connecting parts are so dimensioned that the adjusting device will have a constant impedance over its entire length, and this impedance will not essentially change during the adaptation of the electrical length of the connecting line in the area between the two terminal positions.

In the connecting line according to the invention, the outside conductor in the area of the adjusting device is formed, not by the clamping sleeve, but by two housing parts. The threads of the clamping sleeve do not in any essential way influence the electrical contact of the outside conductor. The electrical contact via the two housing parts is precisely defined in each adjusting position.

The inside diameters of the outside conductor and the outside diameters of the inside conductor are so coordinated with each other over the entire length of the adjusting device that the impedance will be the same at any point along the adjusting device. The interval between the inside conductor and the outer conductor is filled in some areas with air and in some areas with a dielectric insulator. The differing dielectric constants of the air and of the insulator must be considered in coordinating the mentioned diameters. The impedance over the entire length of the adjusting device is constant so that any signal reflections are minimized.

The two housing parts of the outside conductor can, during adaptation of the electrical length of the connecting line, for example, be shifted toward each other with a clamping sleeve arranged on the outside. To make the electrical connection of the two housing parts of the outside conductor, a further development of the invention features a housing part on which is attached a spring bushing that engages a longitudinal borehole of the other housing part. The electrical contact between the two housing parts is thus always defined precisely and completely independently of the adjusting position.

The connecting line can be connected to the usual connections at its ends. Special coupling parts are not required.

DETAILED DESCRIPTION OF THE PREFERRED EMBODIMENTS

Figure 1:
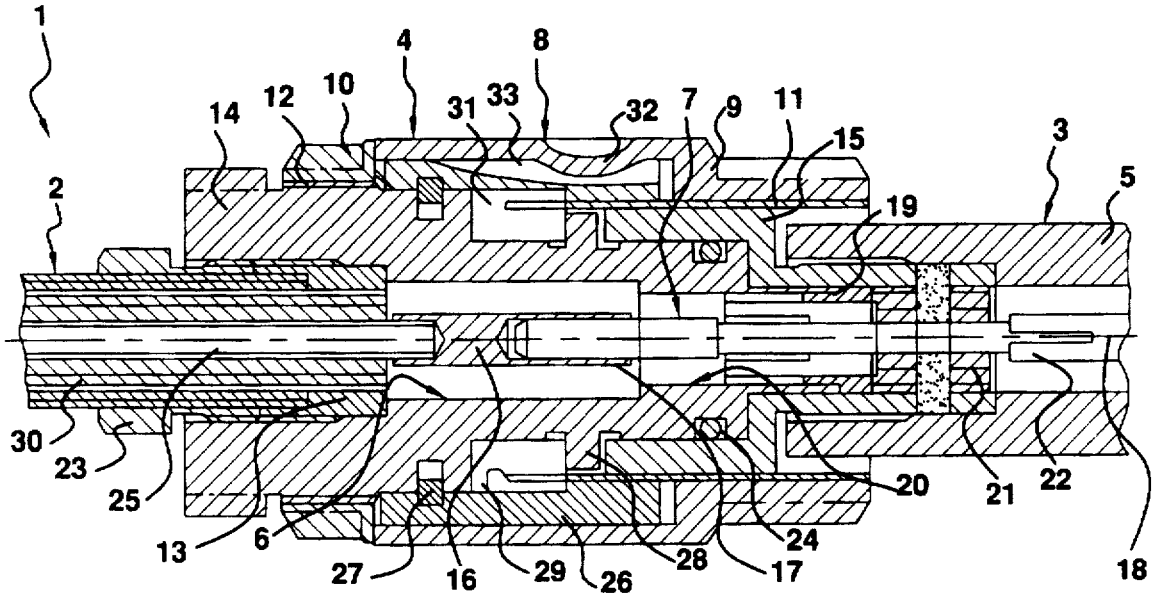
FIG. 1 shows a longitudinal profile through a connecting line according to the invention.

Connecting line 1 has an adjusting device 4 that connects cable parts 2 and 3 with each other. The two parts 2 and 3 each have an inside conductor and an outside conductor. Outside conductor 30 of cable part 2 is electrically connected with a housing part 14 via a clamping sleeve 13 by means of a nipple 23. A suitable clamping sleeve is described in EP-A-0 110 823. Inside conductor 25 of cable part 2 is electrically connected with a connecting part 16 of inside conductor 7 of adjusting device 4. The other cable part 3 is connected by a known connector 5 with another housing part 15 of outside conductor 6 as well as by means of a spring bushing 22 with another connecting part 18 of inside conductor 7. An insulator 21 connects connecting part 18 to housing part 15. The spring bushing 22 engages one end of connecting part 18.

Figure 2:
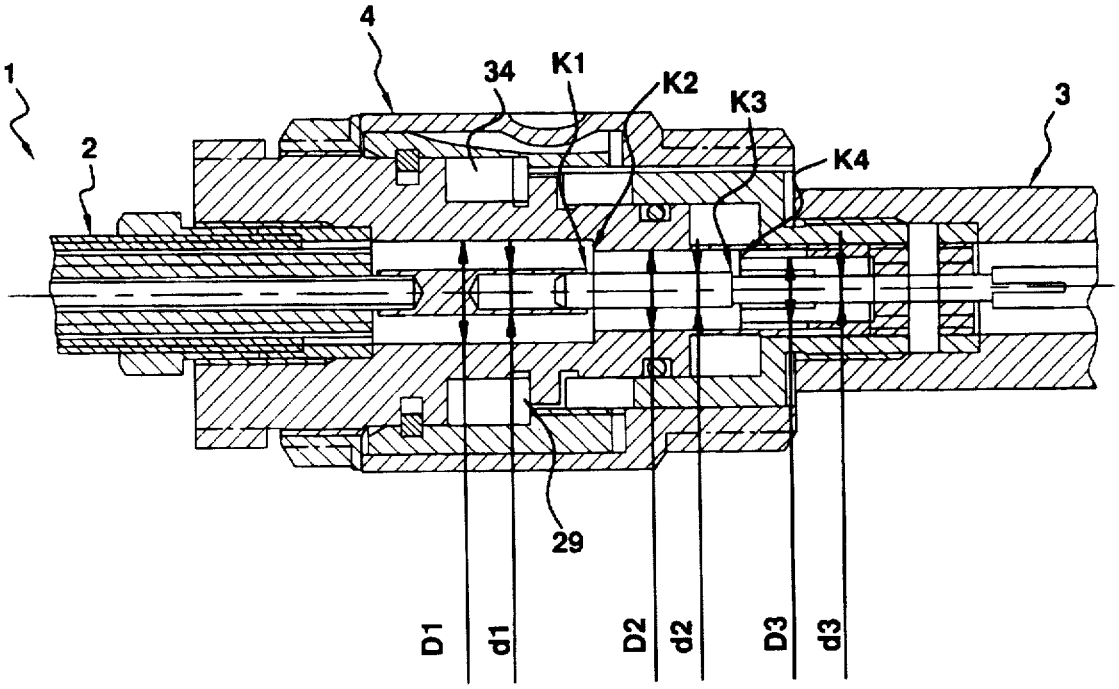
FIG. 2 shows a longitudinal profile according to FIG. 1, but in a different adjusting position.

Outside conductor 6 of adjusting device 4 is thus formed by the two housing parts 14 and 15. The electrical contact between these housings parts is ensured by a spring bushing 19 that movably engages a borehole 20 of housing part 14 and that can be shifted in the borehole. As shown in FIG. 2, the narrowing of the inside diameter D2 to the smaller inside diameter D3 of spring bushing 19 is taken into account by a reduction of the outside diameter d2 of connecting part 18 by a similar amount with respect to diameter d3 to keep the impedance constant. The corresponding edges K3 and K4 remain constant with respect to each other in every position during the shifting of the spring bushing 19 in borehole 20.

The two housing parts 14 and 15 of outside conductor 6 are connected with each other by a clamping device 8. The clamping device 8 has a clamping sleeve 9 that, on the outside, grips around outside conductor 6, as well as a lock nut 10. Clamping sleeve 9 engages housing part 15 via threads 11 and engages housing part 14 via a sleeve 26 and a snap ring 27. Snap ring 27 connects sleeve 26 inseparably to housing part 14. Depressions 32 in clamping sleeve 9 engage recesses 33 of sleeve 26 and connect clamping sleeve 9 with sleeve 26 so that it cannot be twisted. As clamping sleeve 9 is turned, the two housing parts 14 and 15 and connecting parts 16 and 18 of inside conductor 7, which are firmly connected with them, are shifted phaselessly toward each other. FIG. 1 shows a terminal position in which the adjusting device 4 has the least length. The two housing parts 14 and 15 and connecting parts 16 and 18 here are completely shifted into each other. FIG. 2 shows the other terminal position in which the adjusting device 4 has the greatest length. Every position can be precisely adjusted between the terminal positions by correspondingly turning clamping sleeve 9. The position thus set is fixed by tightening the lock nut 10 that engages housing part 14 via threads 12.

The electrical contact between connecting parts 16 and 18 is ensured by a spring bushing 17 in which one end of connecting part 18 is engaged. The enlargement of outside diameter d2 to d1 by means of spring bushing 17 is accounted for by an enlargement of the inside diameter D2 to D1. The corresponding edges K1 and K2 have a certain constant interval with respect to each other, independently of the adjustment. The corresponding reflection points, therefore, remain constant even in the case of an adjustment. The value D with respect to d remains constant during adjustment over the entire length of the adjusting device and, for example, amounts to 2.3.

So that the two parts 2 and 3 cannot be turned toward each other during adjustment, housing part 15 has two longitudinal slits 31 in which are longitudinally guided pins 28 that are attached to housing part 14. Stop parts 29 on housing 15 engage recesses 34 (FIG. 2) of housing part 14 and limit the adjusting range.

We claim:

1. Coaxial electrical connecting line (1) with an integrated trimmer (4) for the mechanical fine adjustment of the electrical length of the connecting line, said trimmer having an outside conductor (6) and an inside conductor (7), said outside conductor having two housing parts (14, 15) which can be moved phaselessly toward and away from each other between two terminal positions by means of a surrounding clamping device (8), said inside conductor having two connecting parts (16, 18) that can be moved toward and away from each other, each of said connecting parts being connected to an associated housing part, the inside diameters (D) of the two housing parts and the outside diameters (d) of the two connecting parts (16, 18) being so dimensioned that the trimmer will have a constant impedance over its entire length, said impedance not substantially changing during an adjustment of the electrical length of the connecting line between the two terminal positions, and further comprising means (10) for fixing an adjusted length of the line in any relative position of said two housing parts.

2. Line according to claim 1, wherein one of the housing parts (15) has a spring bushing (19), which movably engages a longitudinal borehole (20) of the other housing part (14).

3. Line according to claim 1, wherein one of the connecting parts (16) has a spring bushing (17) in which the other connecting part (18) is engaged in a longitudinally movable fashion.

4. Line according to claim 1, wherein a connector (5) is attached on one of the housing parts (15) of the outside conductor (6).

5. Line according to claim 1, wherein the clamping device (8) has a clamping sleeve (9) connected to the two housing parts.

6. Line according to claim 5, wherein the clamping sleeve (9) engages one of the housing parts (15) via threads (11) and the other housing part (14) via a sleeve (26).

7. Line according to claim 1, further comprising a seal (24) arranged between the two housing parts (14, 15) of the outside conductor (6).

* * * * *